US006398578B1

(12) United States Patent
Huang

(10) Patent No.: US 6,398,578 B1
(45) Date of Patent: Jun. 4, 2002

(54) FAST CONNECTING STRUCTURE FOR FITTING LIGHT

(75) Inventor: Peter K. H. Huang, Taipei (TW)

(73) Assignee: Shining Blick Enterprise Co., Ltd. (TW)

( * ) Notice: Subject to any disclaimer, the term of this patent is extended or adjusted under 35 U.S.C. 154(b) by 0 days.

(21) Appl. No.: 09/709,336

(22) Filed: Nov. 13, 2000

(51) Int. Cl.[7] ..... H01R 13/62
(52) U.S. Cl. ..... 439/369; 439/359
(58) Field of Search ..... 439/359, 347, 439/351, 352–353, 356–358, 369, 371; 362/219, 225, 226, 457

(56) References Cited

U.S. PATENT DOCUMENTS 4,998,891 A * 3/1991 Bresko ..... 439/369
5,565,728 A * 10/1996 Jung ..... 362/226

* cited by examiner

*Primary Examiner*—Gary Paumen
*Assistant Examiner*—Felix O. Figueroa
(74) *Attorney, Agent, or Firm*—Troxell Law Office PLLC

(57) ABSTRACT

A fast inserting connecting structure for fitting light, and a second article having connecting ends provided with male and female external sleeves. Each of the male and female external sleeves has respectively an extension conduit portion and a bore. The male and female external sleeves are respectively provided with an inserting connecting end and a slipping-over connecting end, in order that when the connecting ends are connected with each other, the inserting connecting end is inserted into said slipping-over connecting end for a fast connection.

3 Claims, 11 Drawing Sheets

FAST CONNECTING STRUCTURE FOR FITTING LIGHT

BACKGROUND OF THE INVENTION

1. Field of the Invention

The present invention is related to a fast inserting connecting structure for fitting light, and especially to a fast inserting connecting structure to be fast and conveniently used with a connecting device provided on an electrical connecting end of a neighboring fitting light or a power line and extension line to be connected.

2. Description of the Prior Art

A fitting light or lighting rope system comprises mainly lamp strings having light emitting or flashing function in a flexible and transparent pipe. It is advantageous in providing a unique decorative effect as provided by a neon tube by light emitting and flashing of a lot of lamp bulbs through a transparent pipe. With the flexible structure which is plastic, the fitting light can be used in various fields for decoration with various patterns. For example, it can be hung on a surface of a building, or can be wrapped on a broad wall with a given pattern to form a marvelous and attractive large light emitting or flashing pattern. And more, it can be wrapped to form on a frame various given shapes such as a heart, a star and a snowman etc. as is disclosed in U.S. Pat. Nos. 4,607,317 and 4,812,956.

In using such a fitting light, it can have any of various decorative patterns in pursuance of designed patterns or requirement of customers. Hence in manufacturing in factories, fitting lights are all in rolled forms. A user buying a fitting light in a rolled form can make cutting according to indicative marks to obtain desired lengths and then the lengths are taken for connection.

FIG. 1 shows a connecting mode of such a conventional fitting light, assuming that a conduit 10 therein is a power line, the end of the power line 10 is provided with an end piece 11, while the end of a desired length of a fitting light 12 cut is provided with holes 121, 122 for connecting. A connecting seat 13 is provided on the two opposite sides thereof with metallic guide pins 131 and 132 respectively, the guide pins 131 and 132 can be inserted respectively into corresponding holes 121, 122 of the end piece 11 and the fitting light 12; then a connecting piece is used to ensure the connection. In the drawing shown, the structure of the connecting piece often used includes two semi-cylindrical housing parts 14, 15. The housing part 14 is provided with four corner screw holes 16, while the housing part 15 is provided at the corresponding positions with holes 17 for locking therein screws 18 to connect the power line 10 with the fitting light 12.

The structure of the conventional connecting piece of a fitting light has its disadvantage residing in that, when in assembling, screwing in of the screws 18 into the two mutually separated semi-cylindrical housing parts 14, 15 makes the operation of connecting more trouble, time consuming and inconvenient. And a fitting light available in a roll not only renders a consumer to feel complicated and bothersome in requiring a tool to cut and to lock for assembling, but also is uneasy to meet the severer requirement of safety standard of some countries in that the roll of fitting light is cut according to the individually desired length before connecting.

Although the U.S. Pat. No. 4,607,317 disclosed a connecting device for the end of a fitting light, the connecting device includes a plurality of cylinders which must be mutually fitted over and rotated for connection, and includes nuts and sockets. It is complicated as to the components, and is bothersome and inconvenient as to operation of connecting.

SUMMARY OF THE INVENTION

The object of the present invention is to provide a fast inserting connecting structure for a fitting light; it can render the fitting light to make connection fast and conveniently without a tool or professional technique, or only with a simple tool. The fitting light can also be conveniently connected with a power line, an extension line or an end cap to be connected.

To get the above stated object, in the present invention, the connecting areas of the fitting light and another fitting light or a related power line, extension line or end cap have cooperative connecting ends, the connecting ends are provided near by themselves an inserting connecting device for mutual connection. So that when the connecting ends are connected by insertion, the inserting connecting device can directly be connected by insertion with the fitting light or its related power line or extension line.

The inserting connecting device has external sleeves including inserting connecting ends and slipping-over connecting ends, the external sleeves can be movable, or can be movable at one side but fixed at the other side.

In a practicable embodiment of the present invention, the inserting connecting ends of the inserting connecting device can be a plurality of single lugs, while the slipping-over connecting ends thereof can be provided each with two separated lugs for mutual connecting.

In another preferred embodiment of the present invention, the inserting connecting ends of the inserting connecting device can be extended elastic hooking pieces, while the slipping-over connecting ends thereof can be provided with corresponding holes for mutual connecting.

In a further practicable embodiment of the present invention, the external sleeves of the inserting connecting device can be provided with a plurality of axial strips separately arranged on the peripheries of them to allow mutual connecting of them; the axial strips have peripheral recesses to be used to bind and connect them.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
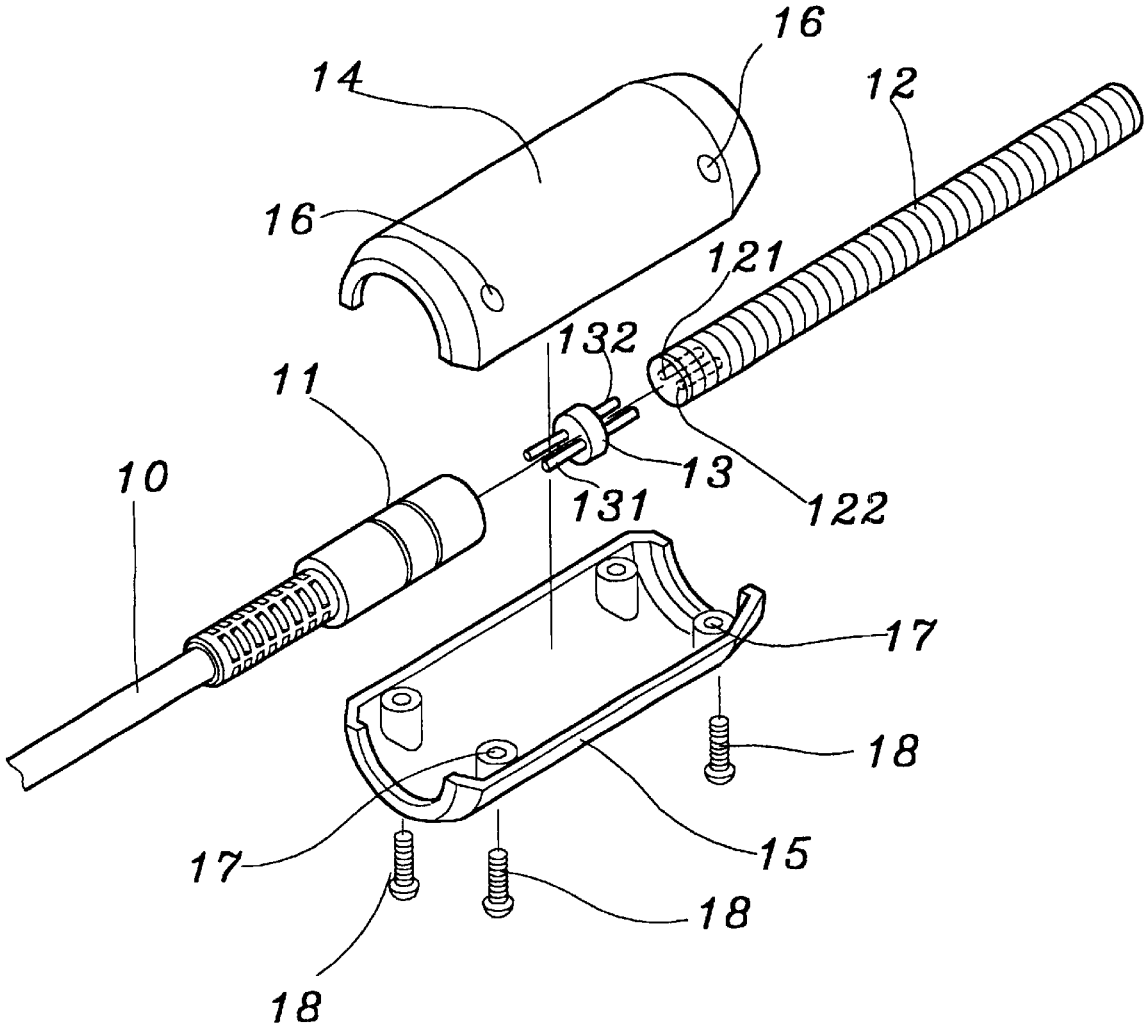
FIG. 1 PRIOR ART
FIG. 1 is an anatomic perspective view showing the structure of a connecting piece of a conventional fitting light.
Figure 3:
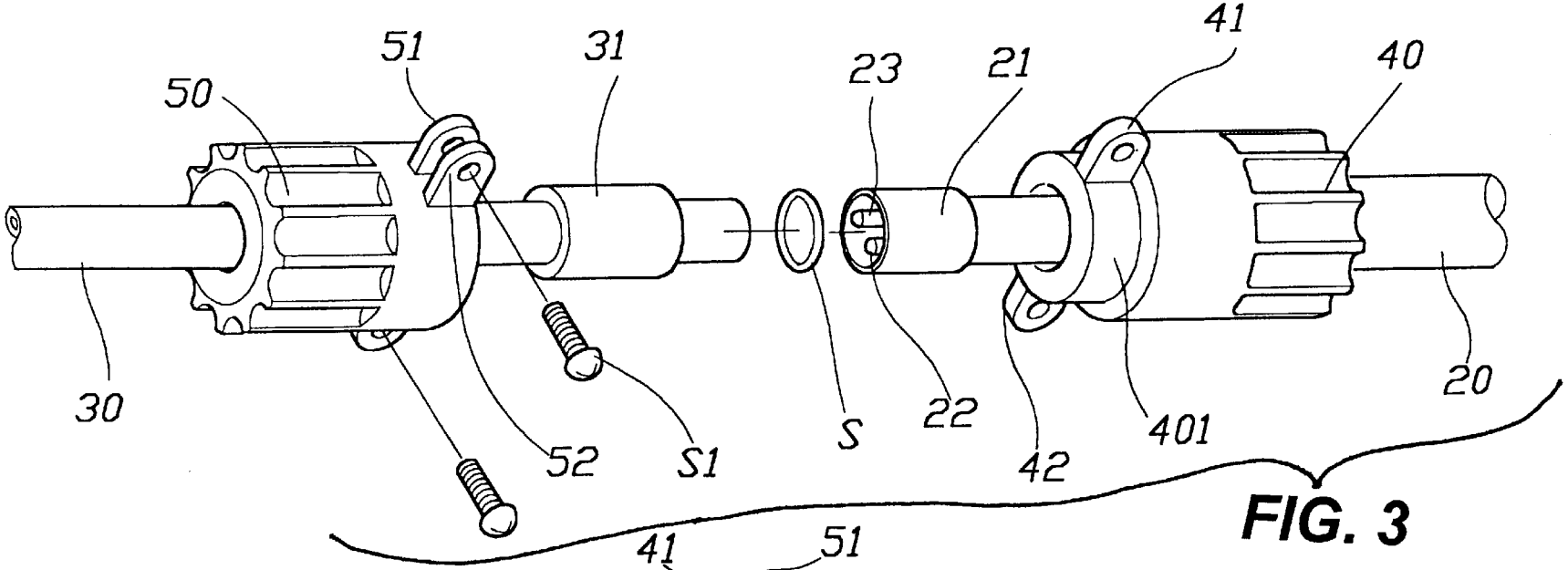
FIG. 3 is an anatomic perspective view showing the elements in FIG. 2.
Figure 2:
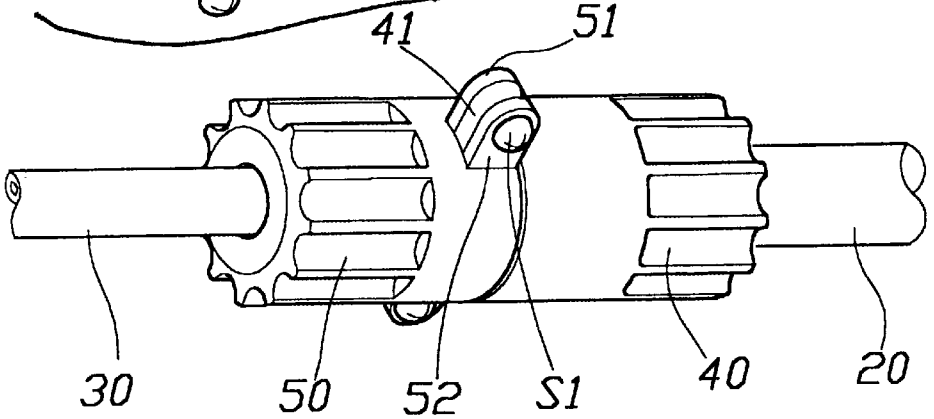
FIG. 2 is a perspective view of a preferred embodiment of the present invention in the state of connection, wherein external sleeves and their inserting connecting ends and slipping-over connecting ends are all movable.

Referring to FIGS. 2, 3, in the example to connect a fitting light 20 and an electrical power line 30 as shown in the drawing, the fitting light 20 and the electrical power line 30 are provided respectively with connecting ends 21 and 31. In the embodiment shown in the drawing, the connecting end 21 of the fitting light 20 is provided with pins 22, 23 connectable with the conductors in the lamp pipe (generally, a fitting light is provided internally with a plurality of lamp strings and conductors); the connecting end 31 of the electrical power line 30 is in the form to be able to connect with the connecting end 21, so that they can be primarily connected in cooperation with a leakage-proof gasket "s" to prevent leakage. Although the connecting ends 21 and 31 of the embodiment can be provided respectively at the ends of the fitting light 20 and the power line 30, they can also be provided respectively at the opposite ends of the fitting light 20 and the related power line or an extension line for it, to make connection of various lengths.

The present invention is characterized by that, an inserting connecting device can be provided near by the connecting ends 21 and 31 and includes a male external sleeve 40 for the connecting end 21 as well as an opposite female external sleeve 50 for the connecting end 31. In the embodiment shown in FIG. 2, 3, the male and the female external sleeves 40, 50 both have a central hole over the connecting ends 21 and 31 respectively, the male external sleeve 40 has an extension conduit portion 401 with a smaller diameter and with two single lugs 41, 42 as their inserting connecting ends; the female external sleeve 50 is provided with a bore in opposition to the extension conduit portion 401 and with two separately arranged lug sets 51, 52 as their slipping-over connecting ends having a slot therebetween. The single lugs 41, 42 can be inserted between their corresponding lug sets 51, 52 and are connected thereto by means of holes and screws "S1" to form the state as shown in FIG. 2.

Figure 4:
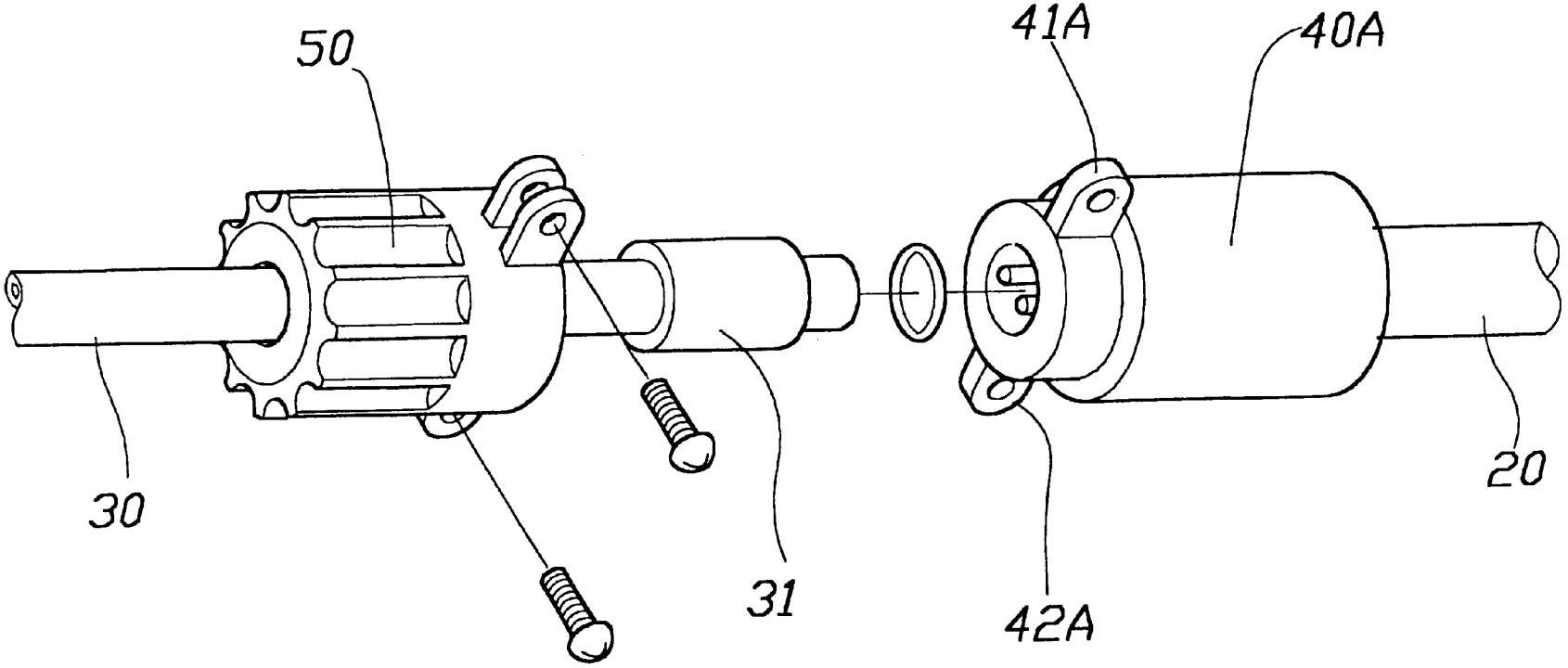
FIG. 4 is an anatomic perspective view showing the elements in FIG. 3, wherein, one of the external sleeves is movable, while the other is fixed.

In another similar embodiment shown in FIG. 4, an inserting connecting end 40A and the two single lugs 41A, 42A of the male external sleeve 40 on the end of the fitting light 20 can all be fixedly shaped on the end of the fitting light 20, while a female external sleeve for the other connecting end is still movable.

Figure 6:
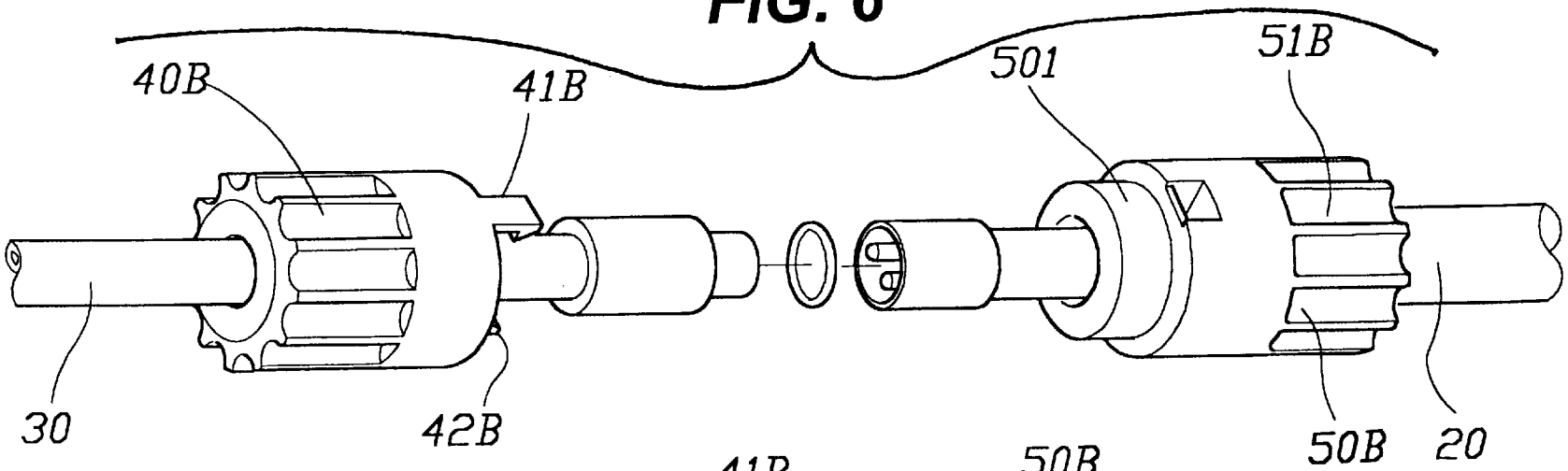
FIG. 6 is an anatomic perspective view showing the elements in FIG. 5.
Figure 5:
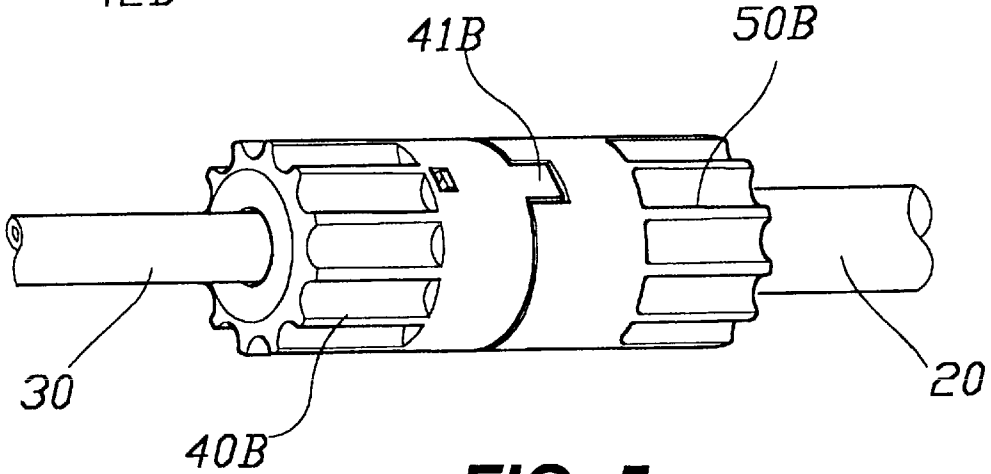
FIG. 5 is a perspective view of the second preferred embodiment of the present invention in the state of connection, wherein external sleeves are movable.
Figure 7:
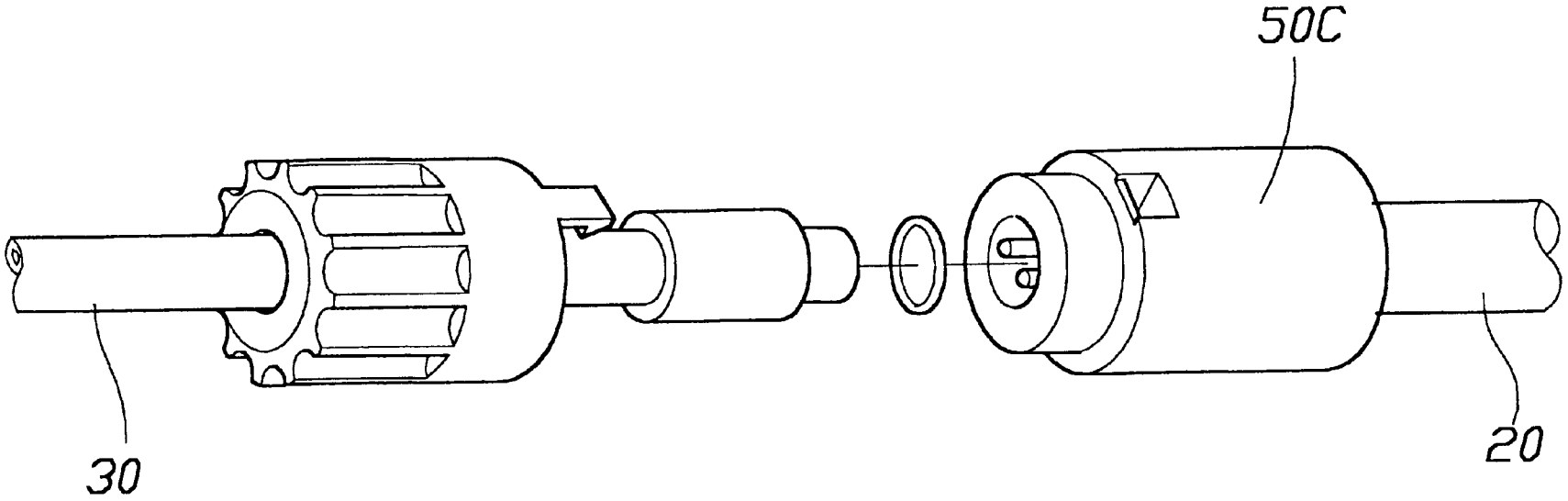
FIG. 7 is an anatomic perspective view showing the elements in FIG. 6, wherein, one of the external sleeves is movable, while he other is fixed.

In another embodiment shown in FIGS. 5, 6, an extension conduit portion 501 on a female external sleeve 50B and a slipping-over connecting hole 51B of the female external sleeve 50B are provided near by the fitting light 20. While the power line 30 has a corresponding male external sleeve 40B which is provided at suitable positions thereon down extending elastic hooking pieces 41B, 42B in cooperation with some engaging holes 51B provided on the female external sleeve 50B for snap connecting by pressing when the extension conduit portion 501 on the female external sleeve 50B is extended into the bore of the male external sleeve 40B. In the embodiment shown in FIG. 7 which is similar to the former embodiment, the female external sleeve 50B and the engaging holes 51B thereof are fixedly provided on the opposite end to the fitting light 20.

Figure 9:
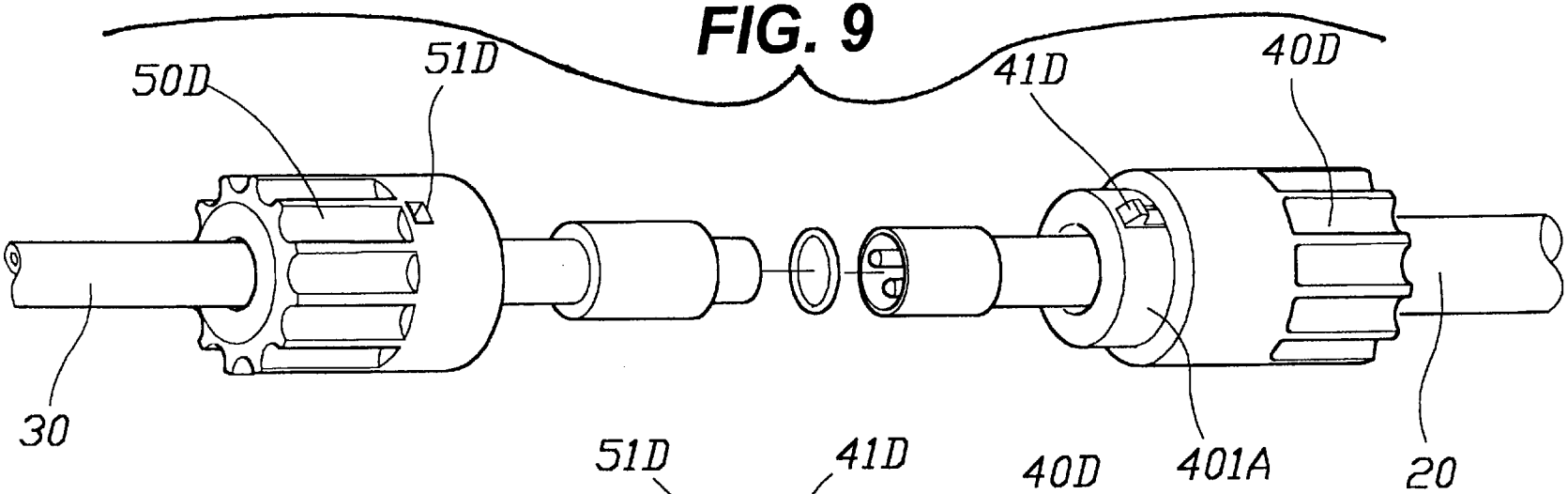
FIG. 9 is an anatomic perspective view showing the elements in FIG. 8.
Figure 8:
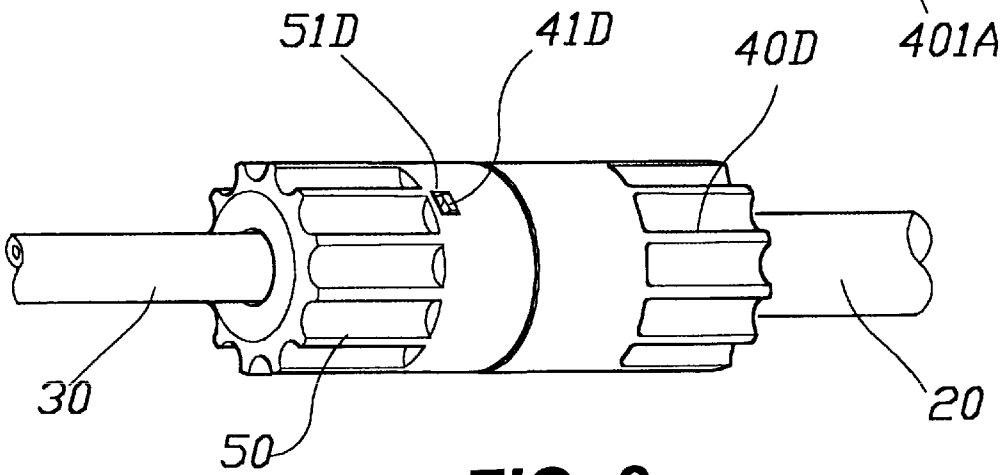
FIG. 8 is a perspective view of the third preferred embodiment of the present invention in the state of connection, wherein external sleeves are movable.
Figure 10:
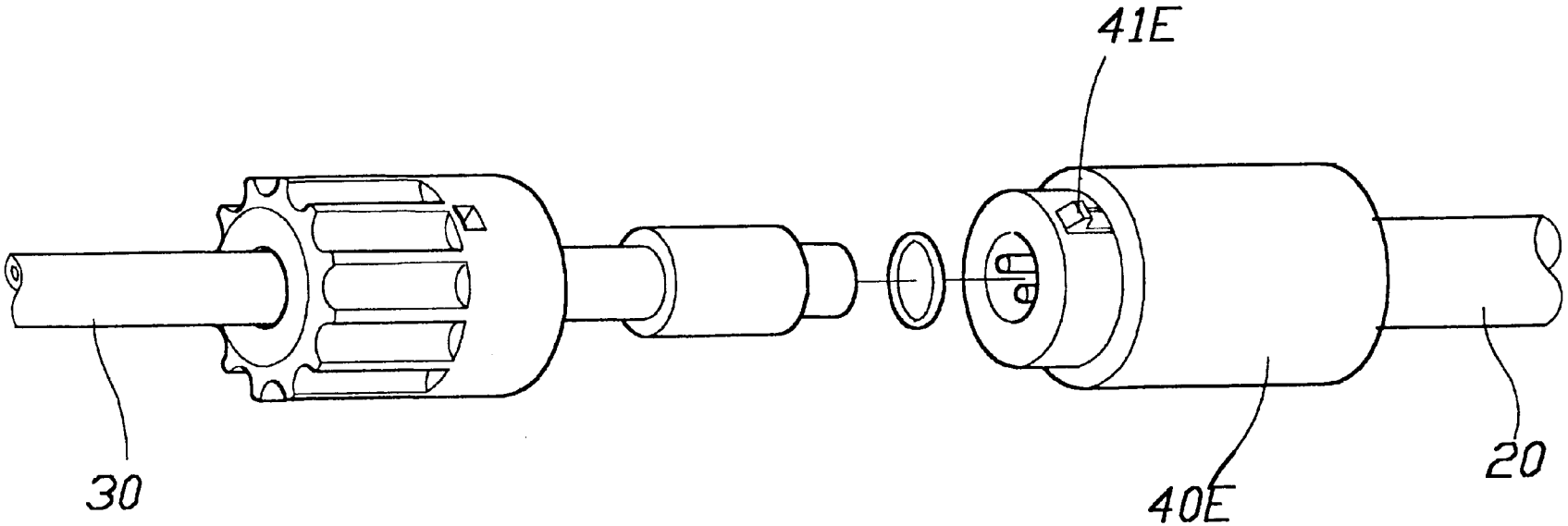
FIG. 10 is an anatomic perspective view showing the elements in FIG. 9, wherein, one of the external sleeves is movable, while the other is fixed.

In the third embodiment shown in FIGS. 8, 9, a male external sleeve 40D provided near the connecting end of the fitting light 20 is provided on an extension conduit portion 401 with elastic hooking pieces 41D extending upwardly; while a female external sleeve 50D provided near the connecting end of the power line 30 is provided with engaging holes 51D to make fast connecting of the two sleeves. In the similar embodiment shown in FIG. 10, a male external sleeve 40E of the fitting light 20 and elastic hooking pieces 41E thereof are also fixedly provided on the opposite end to the fitting light 20.

Figures 11, 12:
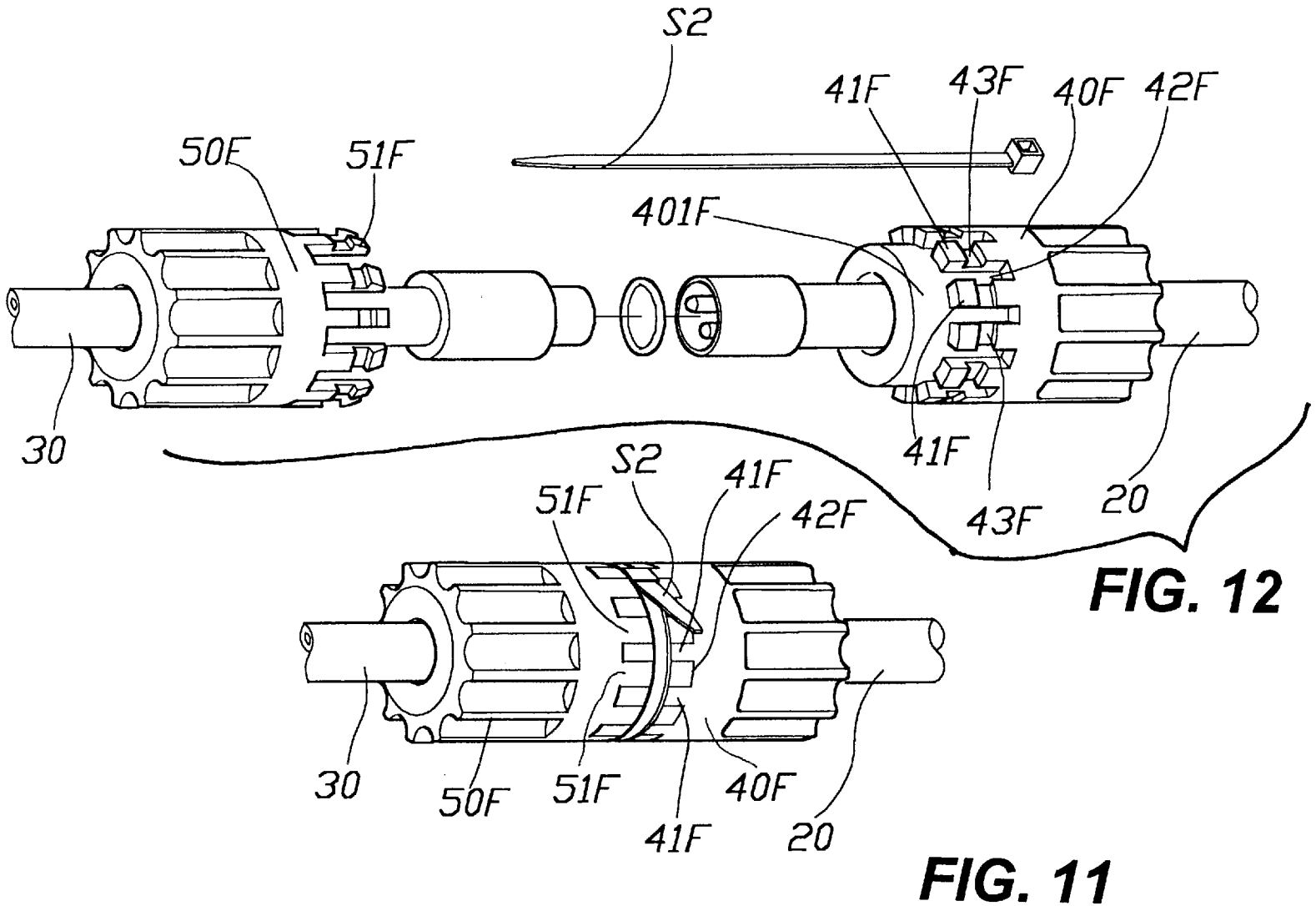
FIG. 11 is a perspective view of the fourth preferred embodiment of the present invention in the state of connection, wherein external sleeves are movable.
FIG. 12 is an anatomic perspective view showing the elements in FIG. 11.
Figure 13:
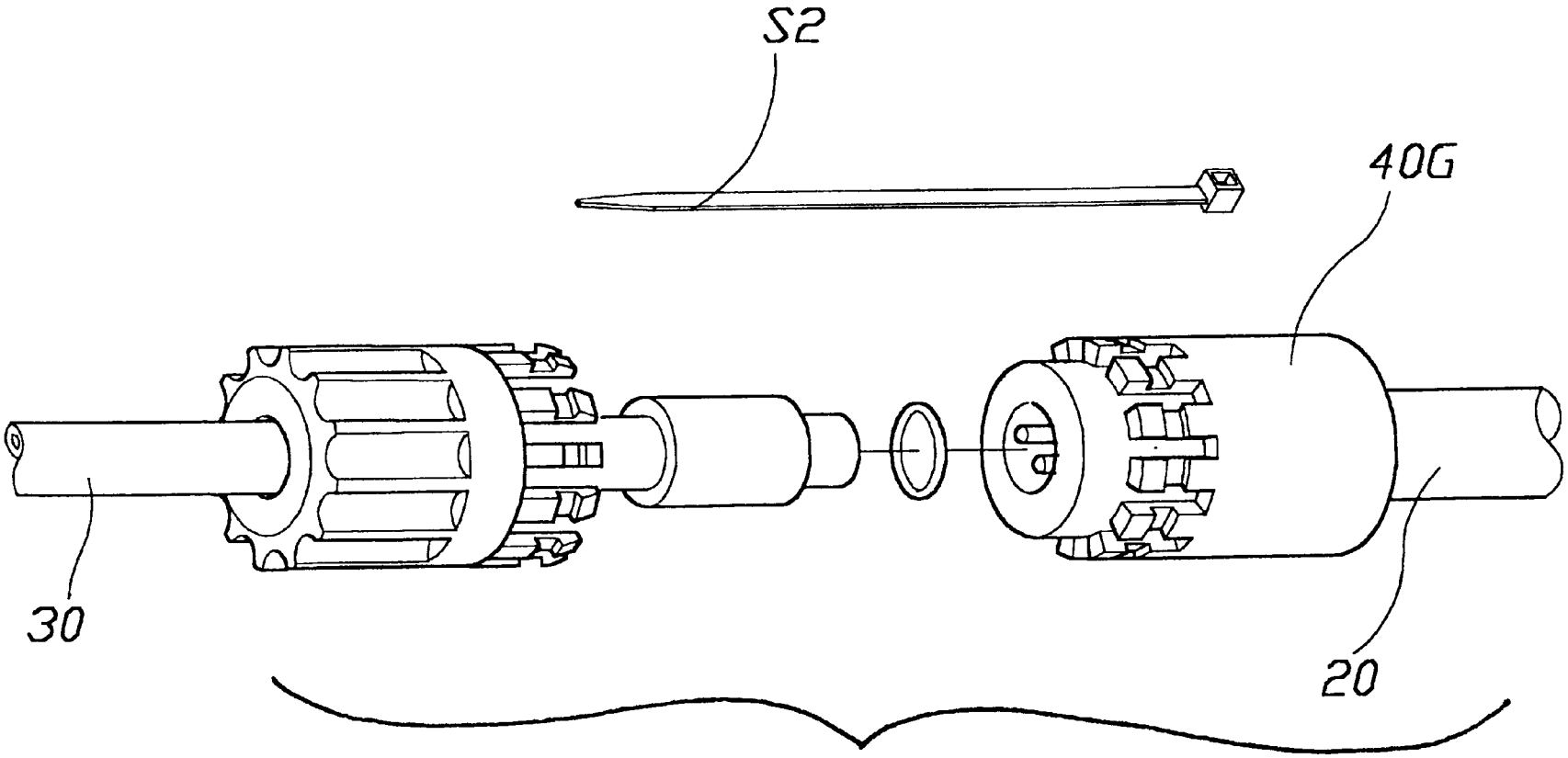
FIG. 13 is an anatomic perspective view showing the elements in FIG. 12, wherein, one of the external sleeves is movable, while the other is fixed.

In the fourth embodiment shown in FIGS. 11, 12, a male external sleeve 40F provided near the connecting end of the fitting light 20 is provided with an extension conduit portion 401F with a smaller diameter, and with a plurality of separately arranged axial strips 41F with an insertion slot between every two axial strips 41F, the axial strips 41F have peripheral recesses 43F at about the middle positions thereof. The end of a female external sleeve 50F neighboring to the connecting end of the power line 30 is also provided with a plurality of axial strips 51F. Thereby, when the axial strips 41F, 51F of the male and female external sleeves 40F, 50F are closed to each other, The axial strips 41F, 51F will engage with their corresponding insertion slots to have all the peripheral recesses aligned, and a binding tape "S2" is used to bind and connect them. In the similar embodiment shown in FIG. 13, a male external sleeve 40G is directly fixedly provided on the end to the fitting light 20.

Figure 14:
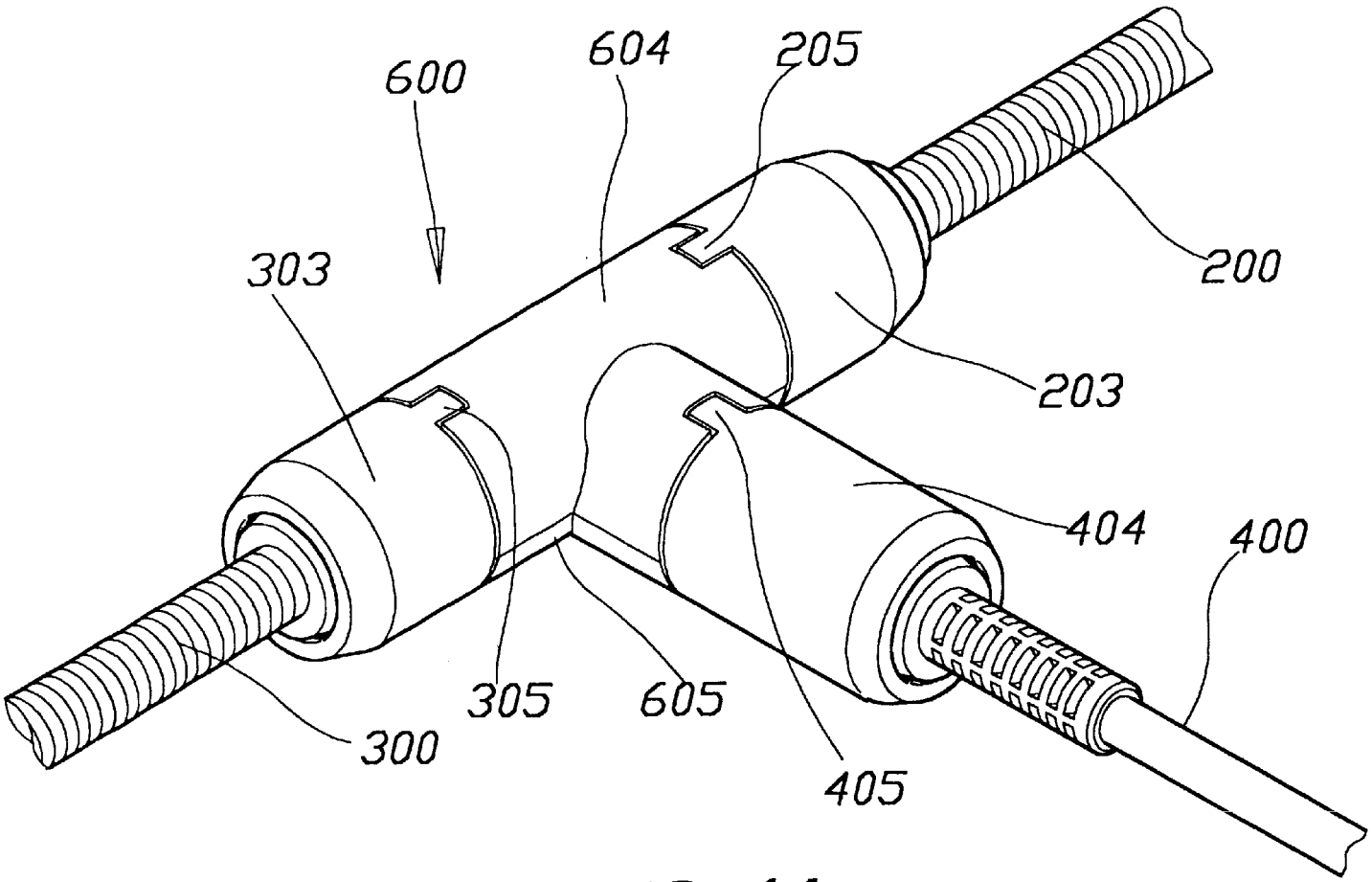
FIG. 14 is perspective view showing a multiple connector used in the embodiments of FIGS. 5 and 6.
Figure 15:
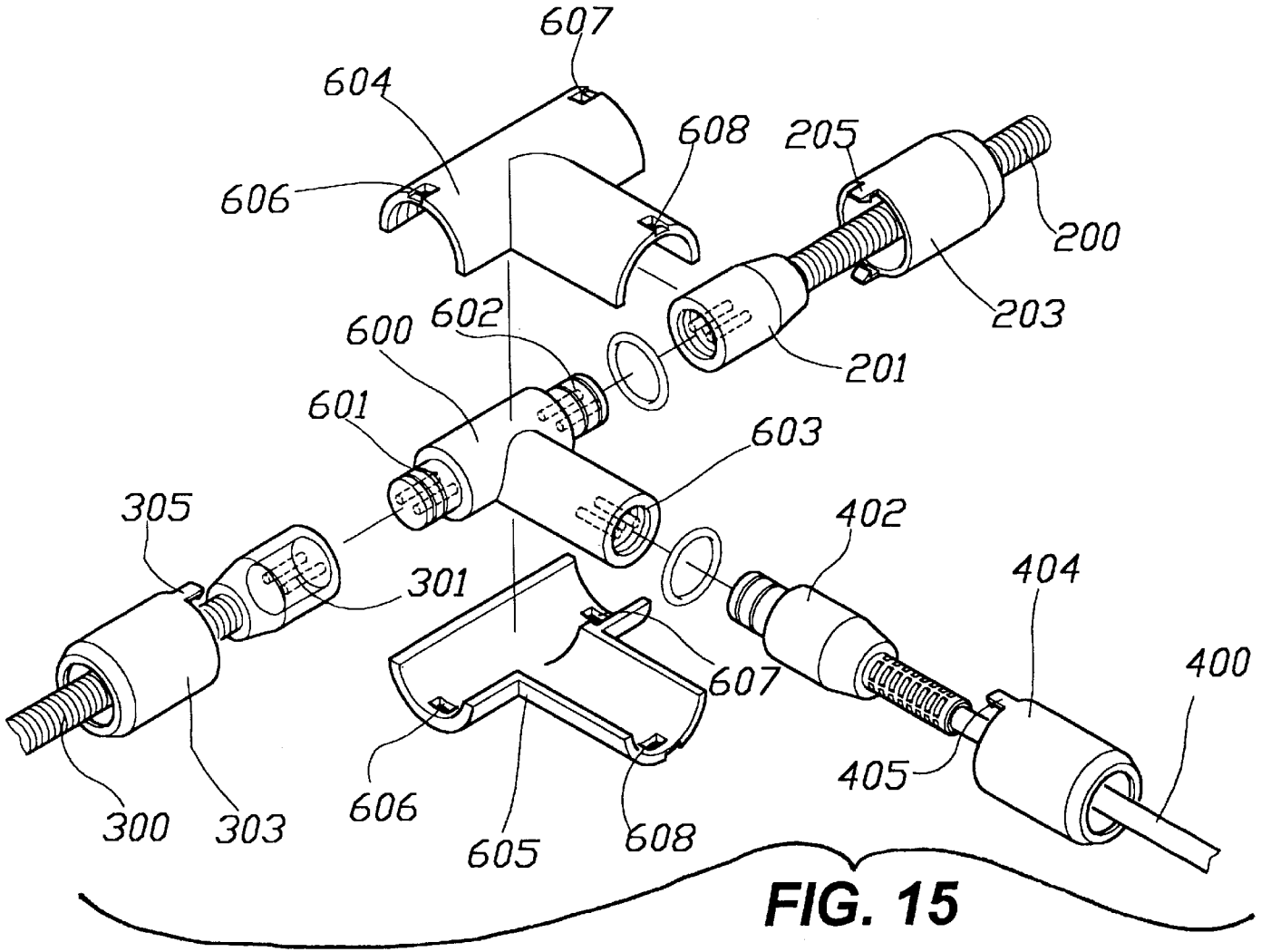
FIG. 15 is an anatomic perspective view showing the elements in FIG. 14.

In the embodiment shown in FIGS. 14, 15, we can see that the present invention can also be used on a multiple connector. In these drawings, a power line 400 connects two fitting lights 200, 300. A multiple connector 600 is provided for such connection, the multiple connector 600 is provided with connecting ends 601, 602 and 603, two half housing parts 604, 605 cover them. The half housing parts 604, 605 can also be provided with engaging holes 606, 607 and 608 for fast connecting and locking a plurality of elastic hooking pieces 205, 206 and 207 on a plurality of external sleeves 203, 303 and 404 of the members 200, 300 and 400 to be connected.

The improved inserting connecting structure of the present invention can make fast and firm connection between fitting lights, or a fitting light and its related power line, extension line or end cap without any tool or professional technique, or only with a simple tool. The fitting light can also be conveniently connected with a power line, an extension line or an end cap to be connected.

The embodiments cited above are only for illustrating a preferred embodiment of the present invention. It will be apparent to those skilled in this art that various modifications or changes can be made to the elements of the present invention without departing from the spirit and scope of this invention.

What is claimed is:

1. A fast inserting connecting structure for a fitting light, and a second article having cooperative connecting ends provided with male and female external sleeves having respectively an extension conduit portion and a bore, said male and female external sleeves having an inserting connecting end and a slipping-over connecting end, such that, when said connecting ends are connected with each other, said inserting connecting end is inserted into said slipping-over connecting end to fast connect said fitting light with said second article wherein said male external sleeve end is provided with a plurality of single lugs with holes and said female external sleeve is provided with two separately arranged lug sets as said slipping-over connecting end.

2. The fast inserting connecting structure as claimed in claim 1, wherein said male and female external sleeves are both movable.

3. The fast inserting connecting structure as claimed in claim 1, wherein one of said male and female external sleeves respectively is movable, while the other of said male and female external sleeves is fixed.

* * * * *